US007367249B1

(12) United States Patent
Chiang

(10) Patent No.: US 7,367,249 B1
(45) Date of Patent: May 6, 2008

(54) QUICK RELEASE DEVICE OF A SOCKET WRENCH

(76) Inventor: Che Ming Chiang, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 11/730,769

(22) Filed: Apr. 4, 2007

(51) Int. Cl.
*B25B 23/16* (2006.01)
*B25G 3/38* (2006.01)
*B25G 3/18* (2006.01)

(52) U.S. Cl. ..... 81/177.85; 81/177.7; 403/325

(58) Field of Classification Search ..... 81/177.85, 81/177.8, 177.2, 177.7; 403/322.2, 328, 403/324, 325
See application file for complete search history.

(56) References Cited

U.S. PATENT DOCUMENTS 4,614,457 A * 9/1986 Sammon ..... 403/322.2
6,003,414 A * 12/1999 Hsieh ..... 81/177.85
6,006,632 A * 12/1999 Hsieh ..... 81/177.85
6,267,032 B1 * 7/2001 Hsieh ..... 81/177.85
6,755,100 B1 * 6/2004 Chen ..... 81/177.85
6,857,341 B1 * 2/2005 Cheng ..... 81/177.8
6,889,582 B2 * 5/2005 Wilhelm ..... 81/177.85

* cited by examiner

*Primary Examiner*—Hadi Shakeri
(74) *Attorney, Agent, or Firm*—Charles E. Baxley

(57) ABSTRACT

A quick release device of a socket wrench has a press rod and a push rod disposed in a socket plug so that the push rod can press against the press rod and the press rod can be pushed and returned toward either side. Thus, a locking steel ball can be tightly pressed or released, and a socket and the plug can be quickly released and replaced in a laborsaving manner.

1 Claim, 4 Drawing Sheets

QUICK RELEASE DEVICE OF A SOCKET WRENCH

BACKGROUND OF THE INVENTION

1. Field of the Invention

The invention relates to a quick release device of a socket wrench, wherein a simple set of a press rod and a push rod is utilized to facilitate the quick release of a socket so that a locking steel ball may be controlled to be tightly pressed and released in a most convenient and laborsaving manner.

2. Description of the Prior Art

A conventional socket wrench, as shown in FIG. 1, is mainly composed of a handle 10 and a socket plug 11. A locking steel ball 12 is embedded onto the socket plug 11 in order to strengthen a pressing force between the socket plug 11 and a socket (not shown) and to prevent the socket from being detached to cause the inconvenience.

When the socket wrench is being implemented, the locking steel ball 12 is fixedly embedded into the socket plug 11 so that the socket and the plug may be combined tightly. However, when the user is detaching the socket, he or she has to apply a relatively large force in order to combine the two objects together or separate the two objects from each other. Thus, the design causes the significant inconvenience, which has to be improved.

Furthermore, after the two objects are forced to combine together and separate for a long period of time, the locking steel ball 12 may be worn and the pressing force is thus decreased or even lost. Thus, the work cannot be conveniently done, and the wrench has to be replaced with a new one frequently. Consequently, the conventional wrench is not a utility product, cannot meet the economic consideration and satisfy the ideal design, and thus has to be improved.

SUMMARY OF THE INVENTION

Because the conventional socket wrench does not have the ideal design, the invention provides a quick release device of a socket wrench according to the experience and the technology. The main object of the invention is to provide the quick release device having a press rod and a push rod disposed in a socket plug, wherein the press rod can be pushed back and forth so that the push rod may be moved back and forth, and a locking steel ball at a front end can be controlled to tightly press against a socket or be released from the socket in a convenient manner.

Another object of the invention is to control the locking steel ball to tightly press against or be released from the socket in order to ensure the socket to be tightly combined with the socket plug and provide the user a quick and laborsaving mode of attaching the plug to the socket or detaching the plug from the socket. Thus, the wear of the socket plug can be reduced, the drawback of the conventional socket wrench can be effectively solved, and the value in the commercial usage may be enhanced.

Still another object of the invention is to provide locking portions dug in through holes at the front end of a handle head, wherein the press rod can be pushed in two directions according to the locking relationship between return springs and the press rod. Thus, the invention can provide the user a more convenient operation mode.

To achieve the above-identified objects, the invention provides a quick release device including a socket plug in which a press rod and a push rod perpendicular to each other are disposed. The press rod may be pressed inwards from either side so as to move the push rod upwards or to loosen the press rod to make the push rod return to the original locking state. Thus, it is possible to control a locking steel ball to fall into the recess at the front end of the push rod effectively, to adjust the pressing force between a socket and the socket plug when they are being combined or separated, and thus to achieve the timesaving and laborsaving requirements.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

The aspects in the structural composition, the technological means and the achieved effects according to the invention will be described with reference to the accompanying drawings according to the preferred embodiment of the invention.

Figure 1:
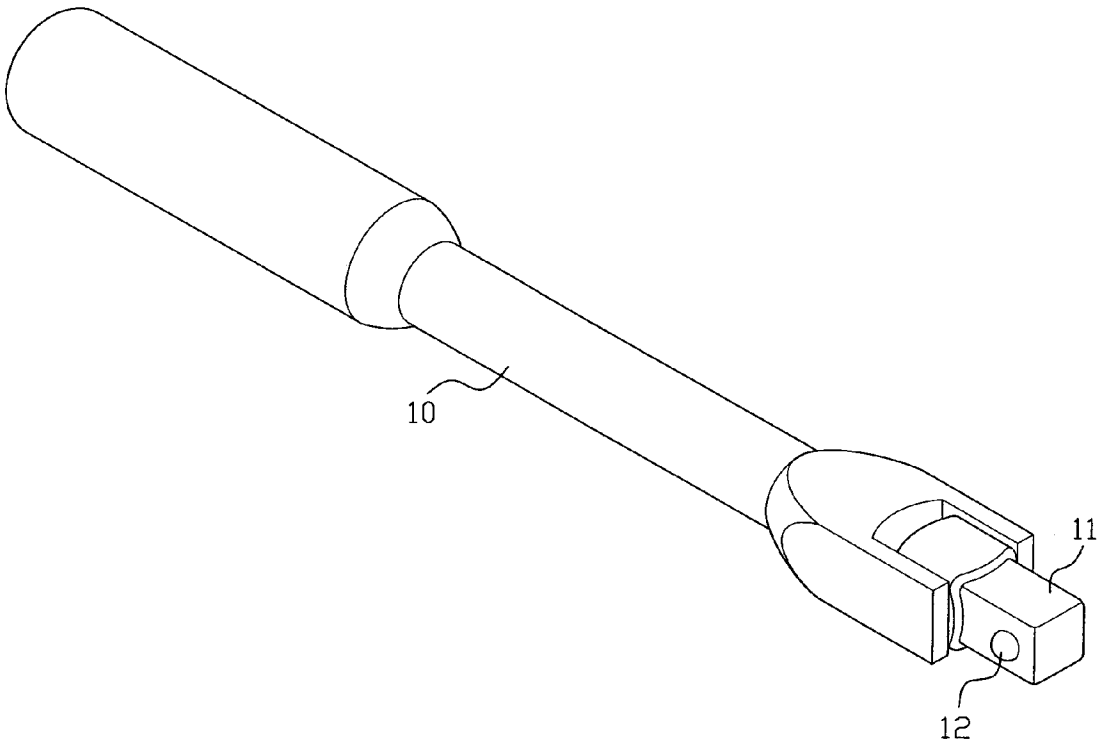
PRIOR ART FIG. 1
FIG. 1 is a pictorial view showing a conventional socket wrench.
Figure 2:
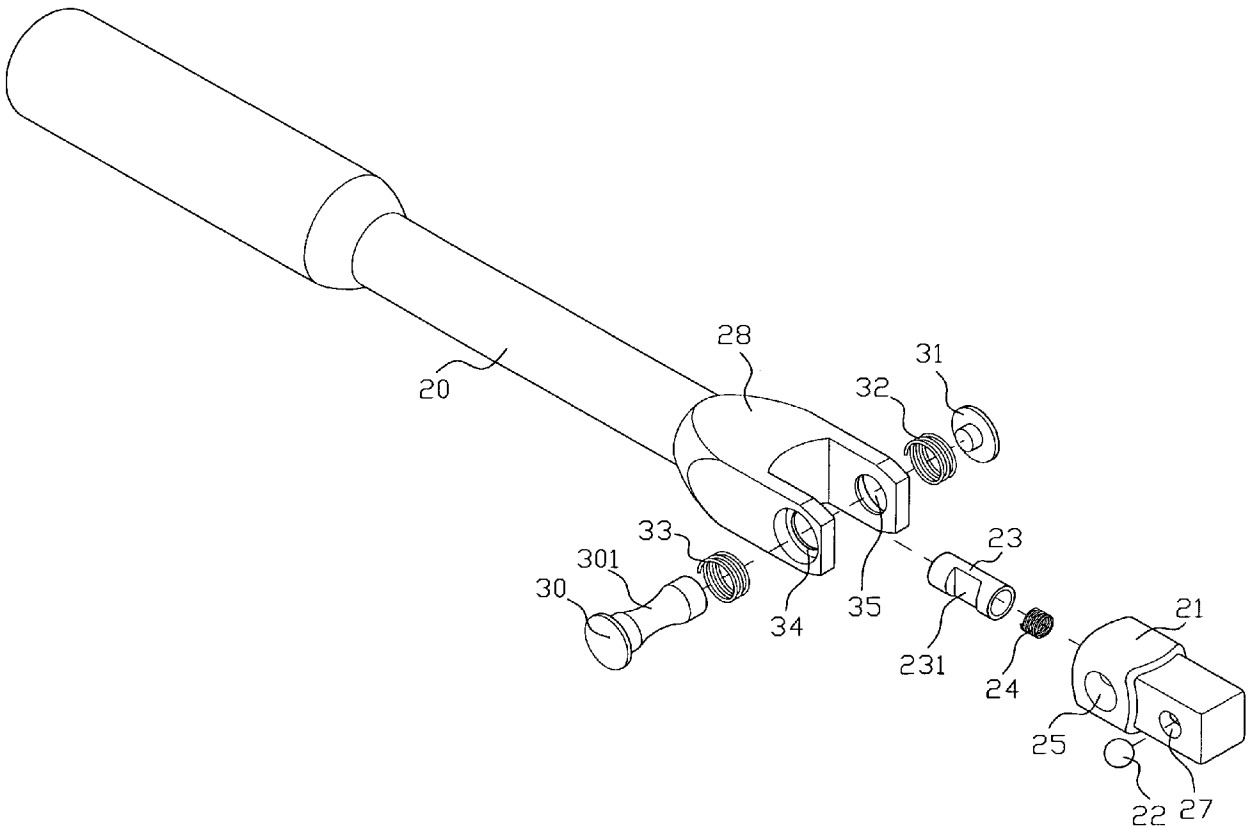
FIG. 2 is a schematically exploded view showing a quick release device of a socket wrench of the invention.
Figure 3:
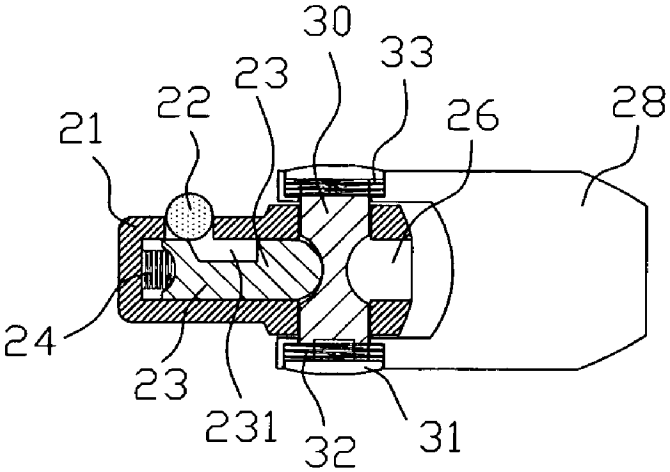
FIG. 3 is a schematically cross-sectional view showing the quick release device of the socket wrench according to the invention.

FIG. 2 is a schematically exploded view showing a quick release device of a socket wrench of the invention. FIG. 3 is a schematically cross-sectional view showing the quick release device of the socket wrench according to the invention. First, as shown in FIGS. 2 and 3, the structure of the invention is mainly composed of a wrench handle 20 and a socket plug 21 having a chamber 26 dug inwards from a rear end of the socket plug 21. A return spring 24 and a push rod 23 are disposed in the chamber 26. Also, through holes 25 and 35 penetrating through corresponding lateral sides of a handle head 28 and the socket plug 21 are formed, and a press rod 30 to be combined with a press-rod head 31 passes through the through holes 25 and 35. In addition, two return springs 32 and 33 are disposed between locking portions 34 and end portions of the press rod 30, respectively, and the press rod 30 presses against the push rod 23 vertically.

Figure 4:
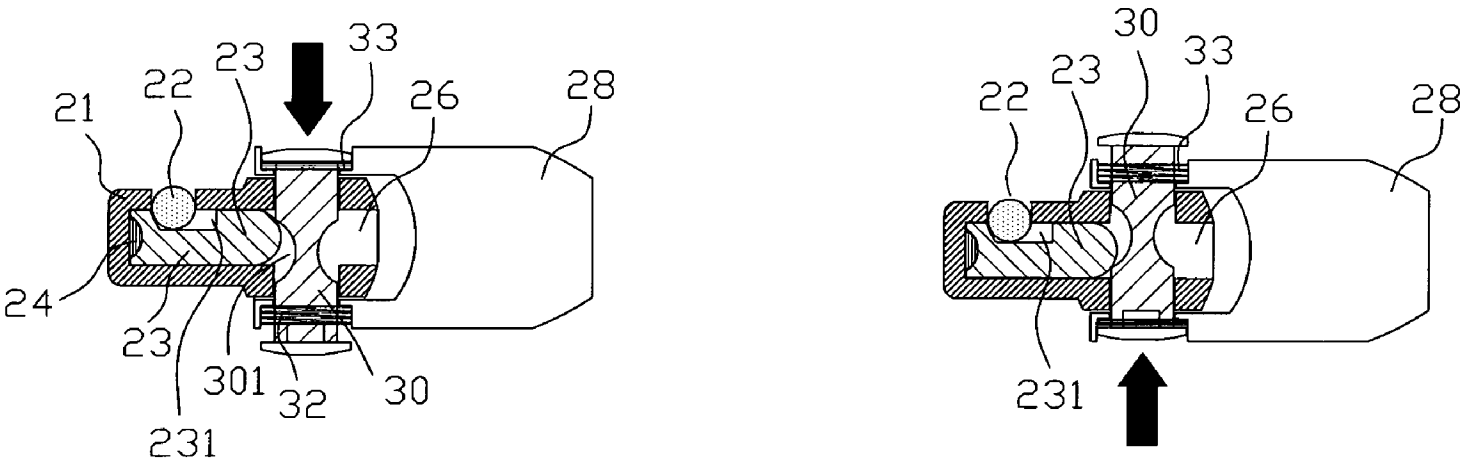
FIG. 4 is a schematically cross-sectional view showing operations of the quick release device of the socket wrench according to the invention.

Furthermore, FIG. 4 is a schematically cross-sectional view showing operations of the quick release device of the socket wrench according to the invention. As shown in FIG. 4, when the press rod 30 is presses inwards from either side, a bevel edge of the concave portion 301 of the press rod 30 pushes the push rod 23 upwards so that a locking steel ball 22, which is originally blocked tightly by a socket (not shown), may fall into a recess 231 of the push rod 23 and the socket can be released. Correspondingly, if the press rod 30 is loosened, the press rod 30 and the push rod 23 return to the original locking state through the return springs 24, 32 and 33, and the locking steel ball 22, which is pushed by the recess 231 of the push rod 23, presses against a hole 27 upwards.

According to the above-mentioned description, the invention controls the locking steel ball 22 to be tightly pressed or released in the hole 27 so as to press the press rod 30 toward either side according to the pressing relationship between the press rod 30 and the push rod 23. Thus, various sockets can be connected with the socket plug 21 in a quick release and laborsaving manner.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A wrench comprising:

a handle head including two locking portions, and including through holes formed in the locking portions of the handle head, a socket plug including a chamber and including through holes formed in the socket plug, and including a hole formed in the socket plug, a press rod disposed in the through holes of the socket plug and in the through holes of the handle head, the press rod including a concave portion formed therein, a locking ball disposed in the hole of the socket plug, a push rod and a return spring disposed in the chamber of the socket plug, the push rod including a recess for selectively receiving the locking ball, and the return spring pressing the push rod to push the locking ball and pressing the push rod to engage with the concave portion of the press rod, and two return springs disposed between the locking portions of the handle head and end portions of the press rod for forcing the press rod to press the push rod, either of the end portions of the press rod being allowed to be pressed to press the push rod and to push the locking ball.

* * * * *